US009134066B2

(12) United States Patent
Chen et al.

(10) Patent No.: US 9,134,066 B2
(45) Date of Patent: Sep. 15, 2015

(54) GLUE-THERMAL CURING EQUIPMENT

(71) Applicant: Quanta Computer Inc., Taoyuan Shien (TW)

(72) Inventors: Ching-Chih Chen, New Taipei (TW); Lin-Huei Wang, Taichung (TW); Lai-Peng Lai, Pingzhen (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 121 days.

(21) Appl. No.: 14/070,434

(22) Filed: Nov. 1, 2013

(65) Prior Publication Data

US 2014/0298677 A1 Oct. 9, 2014

(30) Foreign Application Priority Data

Apr. 8, 2013 (CN) ..... 2013 1 0118560

(51) Int. Cl.
*F26B 21/00* (2006.01)
*F26B 9/06* (2006.01)

(52) U.S. Cl.
CPC ..... *F26B 9/066* (2013.01)

(58) Field of Classification Search
CPC ..... F26B 9/00; F26B 11/00; F26B 21/00; F28D 15/00; F28D 15/02; F28F 13/00; B27D 3/00
USPC ..... 34/549, 201, 210, 218; 165/104.21, 165/185; 345/163; 100/35, 215, 218
See application file for complete search history.

(56) References Cited

U.S. PATENT DOCUMENTS

| | | | | | |
|---|---|---|---|---|---|
| 4,418,511 | A * | 12/1983 | Collin | 53/427 |
| 4,467,534 | A * | 8/1984 | Murase | 34/82 |
| 5,019,206 | A * | 5/1991 | Bielfeldt | 156/538 |
| 6,063,320 | A * | 5/2000 | Horikawa | 264/297.4 |
| 7,150,298 | B2 * | 12/2006 | Kamiya et al. | 141/37 |
| 7,877,895 | B2 * | 2/2011 | Otsuka et al. | 34/78 |
| 2003/0003252 | A1 * | 1/2003 | Yun et al. | 428/36.9 |
| 2005/0028965 | A1 * | 2/2005 | Chen | 165/104.21 |
| 2005/0126030 | A1 * | 6/2005 | Ohmi et al. | 34/58 |
| 2006/0054791 | A1 * | 3/2006 | Lim | 250/216 |
| 2010/0240226 | A1 * | 9/2010 | Ma et al. | 438/795 |
| 2012/0144785 | A1 * | 6/2012 | Vaccari | 53/510 |
| 2014/0178056 | A1 * | 6/2014 | Zhu et al. | 392/411 |
| 2014/0298677 | A1 * | 10/2014 | Chen et al. | 34/549 |

FOREIGN PATENT DOCUMENTS

| | | | | |
|---|---|---|---|---|
| GB | 1430555 | A * | 3/1976 | |
| JP | 08006037 | A * | 1/1996 | G02F 1/1339 |
| JP | 2000091218 | A | 3/2000 | |

* cited by examiner

*Primary Examiner* — Stephen M Gravini
(74) *Attorney, Agent, or Firm* — Sawyer Law Group, P.C.

(57) ABSTRACT

A glue-thermal curing equipment includes a chassis, a support, a heating baking plate and a lifting device. The chassis is formed with an accommodation space therein. The support is fixedly disposed in the accommodation space. The heating baking plate is disposed on the support, and has a top surface acting as a heat generating surface. The heat generating surface allows a panel device to be directly disposed thereon, and fully provides uniform thermal energy to a liquid-state glue layer disposed on the panel device. The lifting device is elevatably disposed on the support and enables the panel device to be lifted and separated from the heat generating surface.

10 Claims, 6 Drawing Sheets

GLUE-THERMAL CURING EQUIPMENT

CROSS-REFERENCE TO RELATED APPLICATIONS

This application claims priority to China Application Serial Number 201310118560.2, filed Apr. 8, 2013, which are herein incorporated by reference.

FIELD OF THE INVENTION

The disclosure relates to glue-thermal curing equipment. More particularly, the disclosure relates to glue-thermal curing equipment capable of providing uniform heat.

BACKGROUND

In a manufacturing procedure of a conventional touch display screen, when a touch panel is disposed on a display module, a liquid-state glue layer (e.g., liquid-glue) is often provided on one surface of the touch panel to laminate the touch panel with the display module, so that the touch panel can be adhered on the display module through the liquid-state glue layer. The liquid-state glue layer has to be baked and dried to be a semi-solid glue layer so as to prevent the liquid-state glue layer from randomly flowing on the touch panel which may cause uneven thickness.

SUMMARY

In the present disclosure, glue-thermal curing equipment is provided to overcome the aforementioned shortcomings existing in prior art.

According to one embodiment of the present disclosure, the glue-thermal curing equipment is used for performing baking to dry the liquid-state glue layer applied on at least one panel device. The glue-thermal curing equipment includes a chassis, at least one support, at least one heating baking plate and at least one lifting device. The chassis is formed with an accommodation space therein. The support is fixedly disposed in the accommodation space. The heating baking plate is disposed on the support, and has a top surface acting as a heat generating surface, and the heat generating surface allows a panel device to be directly disposed thereon, and any area of the heat generating surface generates the same thermal energy. The lifting device is elevatably disposed in the accommodation space and used for lifting the panel device so as to enable the panel device to be separated from the heat generating surface.

As what has been disclosed above, the heating baking plate of the glue-thermal curing equipment provided by the present disclosure allows the liquid-state glue layer on the touch panel to be uniformly heated, so that the baking and drying progress of the liquid-state glue layer on the touch panel can be substantially the same, and the thickness and viscosity of the glue layer is substantially the same, thereby effectively ensuring the quality of the touch panel being adhered on a display module and the average service life.

BRIEF DESCRIPTION OF THE DRAWINGS

The present disclosure will be apparent to those skilled in the art by reading the following detailed description of a preferred embodiment thereof, with reference to the attached drawings, in which.

DETAILED DESCRIPTION

The spirit of the disclosure will be described clearly through the drawings and the detailed description as follows. Any of those of ordinary skills in the art can make modifications and variations from the technology taught in the disclosure after understanding the embodiments of the disclosure, without departing from the sprite and scope of the disclosure.

What shall be addressed is that the terms such as "about", "approximate" or "substantial" used in the present disclosure refers to the deviation of values or within a range of 20%, preferably to a range within 10%, and more preferably to a range within 5%. If not specified, the values disclosed in the present disclosure are all defined as approximate values, i.e., having the deviation or the range which has been disclosed above.

One object of the present disclosure is to provide a glue-thermal curing equipment used for baking and drying at least one panel device disposed therein, thereby allowing a liquid-state glue layer (e.g., liquid-glue) applied on the panel device to be baked and dried to be in a semi-solid state. The aforementioned panel device is not limited to a certain type, and can be a panel-like or plate-like member such as a touch panel, a liquid crystal display panel, a solar panel or a metal plate. For providing a clear illustration, the touch panel adopted in the present disclosure is merely used as an example, and shall not be limited to the touch panel field only.

Figure 1:
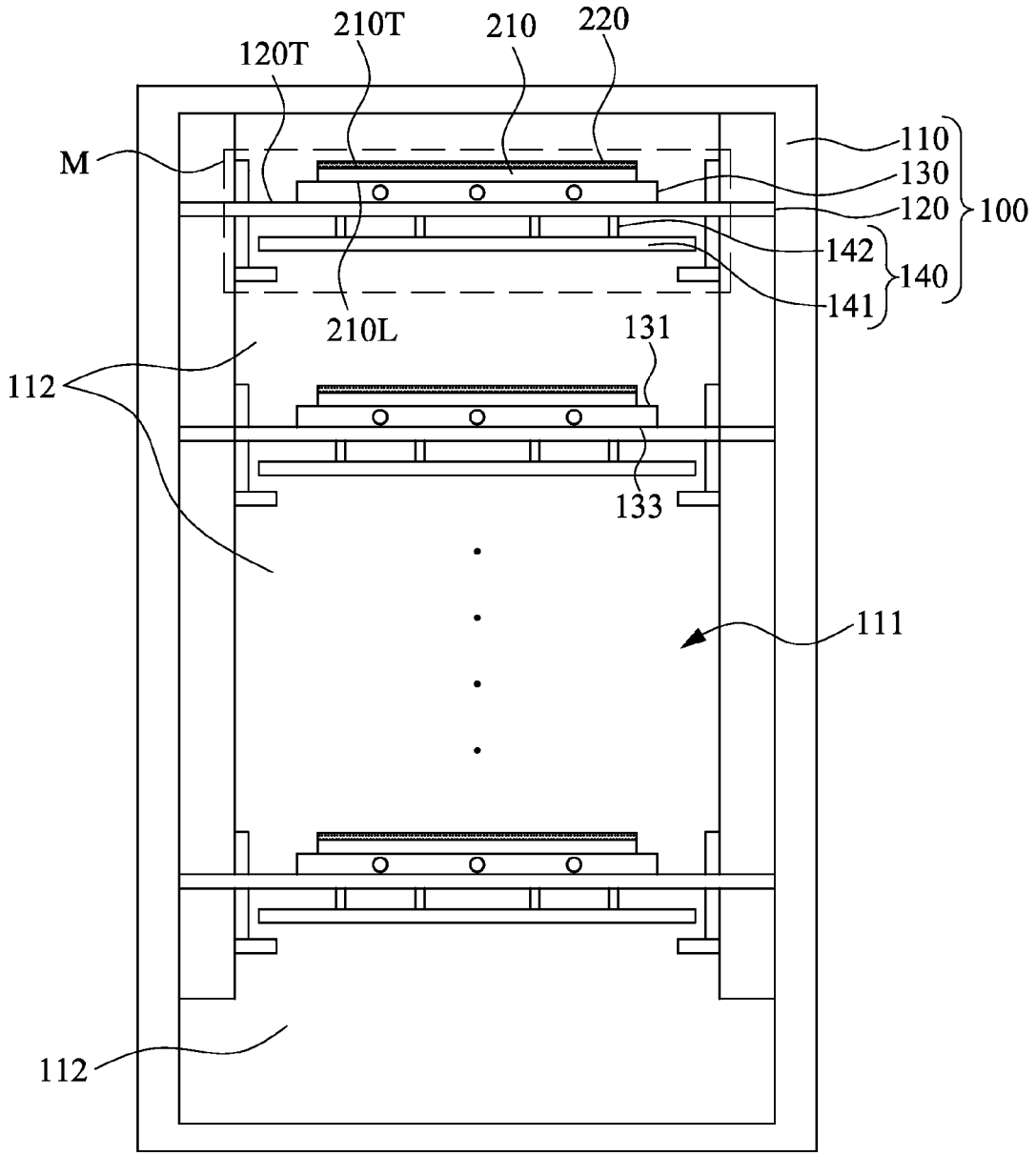
FIG. 1 is a front view showing glue-thermal curing equipment according to one embodiment of the present disclosure.

Reference is now made to FIG. 1, which is a front view showing a glue-thermal curing equipment 100 according to one embodiment of the present disclosure.

The glue-thermal curing equipment 100 includes a chassis 110, supports 120, heating baking plates 130 and lifting devices 140. The chassis 110 is formed with an accommodation space 111 therein. The supports 120 are fixedly disposed in the accommodation space 111. Each of the supports 120 allows at least one heating baking plate 130 to be placed thereon. A top surface of the heating baking plate 130 allows a surface 210L of a touch panel 210 to be directly disposed thereon, and a liquid-state glue layer 220 can be provided on a top surface 210T of the touch panel 210. The top surface of the heating baking plate 130 is formed as a heat generating surface 131. With the uniformly heating feature provided by the heating baking plate 130, the heat generating surface 131 can fully provide the same (or substantially the same) thermal energy, i.e., the thermal energy generated at any area of the heat generating surface 131 is the same (or substantially the same). The area of the heat generating surface 131 is larger than or equal to the area of the surface 210L of the touch panel 210 opposite to the liquid-state glue layer 220. The lifting device 140 is elevatably disposed in the accommodation space 111 and can be lifted for pushing the touch panel 210 to be completely separated from the heat generating surface 131.

Thus, because the heat generating surface 131 of the heating baking plate 130 of the glue-thermal curing equipment 100 can fully provide substantially the same thermal energy, the liquid-state glue layer 220 on the touch panel 210 can be uniformly heated, and the baking and drying progress at all areas of the liquid-state glue layer 220 can be the same (or substantially the same), so that, after the liquid-state glue layer 220 is transformed from the liquid state to the semi-solid state as a glue layer 121 (see FIG. 2), the thickness and viscosity of the glue layer is the same (or substantially the same), and thus, the quality of the touch panel being adhered on a display module and the average service life can be effectively ensured.

Specifically, as shown in FIG. 1, the supports 120 are arranged at intervals along a gravity direction and disposed in the accommodation space 111 in a manner parallel to each other, and a partition 112 is formed by every two adjacent supports 120. Each of the partition chambers 112 allows one or more heating baking plates 130 to be disposed on a top surface 120T of the support 120.

However, what shall be addressed is that the present disclosure is not limited to the arrangement disclosed above, and the accommodation space can also be provided for receiving one single support, one single heating baking plate and one single lifting device, their connecting relationships are the same as those disclosed above, and thus no further illustration is provided.

Figure 2:
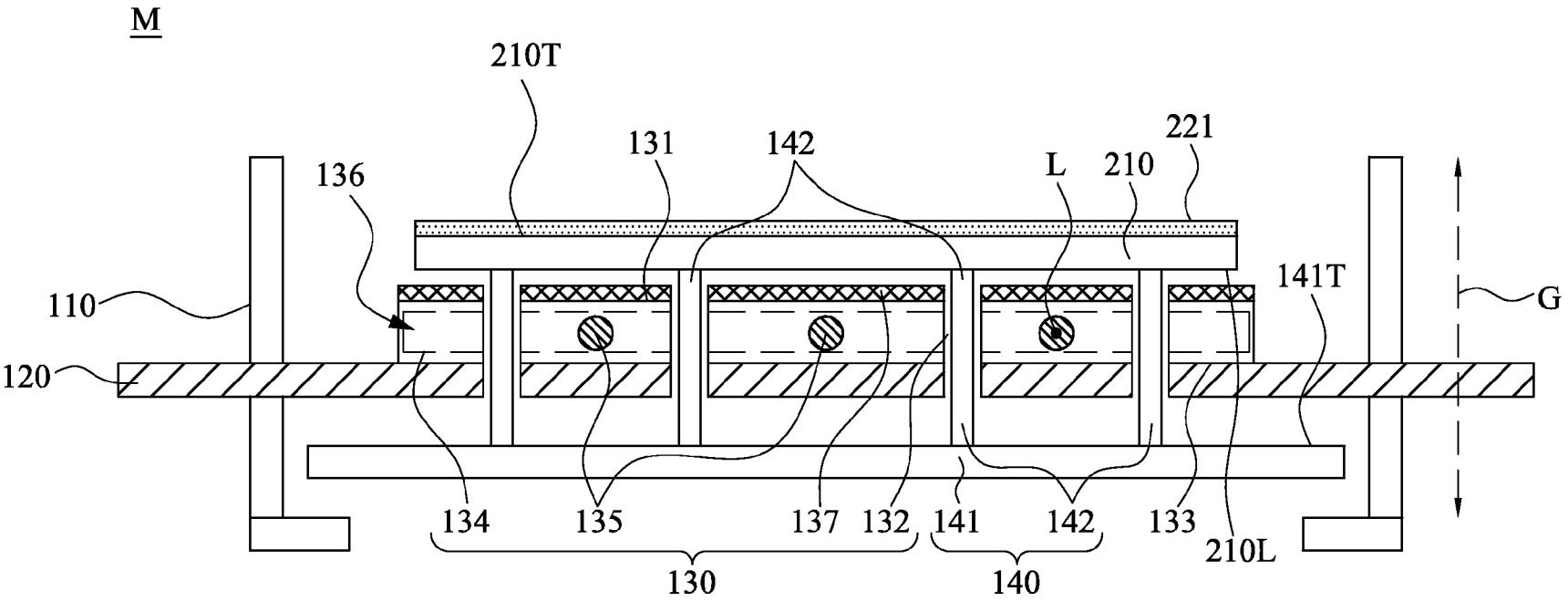
FIG. 2 is a partially enlarged view showing a zone M of the glue-thermal curing equipment shown in FIG. 1 while the touch panel being lifted away from the heat generating surface.

FIG. 2 is a partially enlarged view showing a zone M of the glue-thermal curing equipment shown in FIG. 1 while the touch panel being lifted away from the heat generating surface.

With the uniformly heating feature provided by the heating baking plate 130, all areas of the heat generating surface 131 can provide uniform heating. Substantially, as shown in FIG. 1 and FIG. 2, the heating baking plate 130 includes a metal plate 134 and heating bars 135. The material forming the metal plate 134 is a metal having high heat conductivity, such as aluminum, copper or iron. A vacuum channel 136 is formed in the metal plate 134. The heating bars 135 are arranged at intervals in the vacuum channel 136, and a longitudinal axial direction L of each of the heating bars 135 is perpendicular to a gravity direction G. Furthermore, the heating bars 135 are arranged at equal intervals in the vacuum channel 136. Thus, when the heating bars 135 start to generate heat, the thermal energy is transferred to the heat generating surface 131 and all areas of the heat generating surface 131 can provide uniform heating.

After the heating baking plate 130 generates heat, the interior of the chassis 110 (as shown in FIG. 1) is provided with an internal temperature from 100 degrees Celsius to 120 degrees Celsius. However, the aforementioned temperature range is merely shown as an example, and does not intend to limit the scope of the present disclosure. Those skilled in the art may change the heating capability of the heating baking plate 130 flexibly according to the actual needs.

Moreover, for preventing the touch panel 210 from being scratched easily, the heating baking plate 130 is further coated with a protective layer 137 which is horizontally disposed on the heat generating surface 131. For instance, the protective layer 137, such as a Teflon film, can be formed on the heat generating surface 131 by electroplating. The Teflon film also has a heat conduction effect, which may make the thermal energy on the heat generating surface 131 more uniform. However, the aforementioned materials forming the protective layer are merely shown as examples, and do not intend to limit the scope of the present disclosure. Those skilled in the art may change the material flexibly according to the actual needs.

As shown in FIG. 1 and FIG. 2, when the baking and drying is finished, the lifting device 140 is lifted upwardly to push the touch panel 210, so that a bottom surface 210L of the touch panel 210 can be completely separated from the heat generating surface 131. In details, the lifting device 140 includes a lifting body 141 and pushing pins 142. The supports 120 are disposed between the heat generating surface 130 and the lifting body 141, and the lifting body 141 is elevatably installed on the support 120, so that the lifting body 141 can be ascended or descended along a gravity direction G. The pushing pins 142 are arranged at intervals on a top surface 141T of the lifting body 141, and are connected to the top surface 141T of the lifting body 141, and the pushing pins 142 will be lifted along with the lifting body 141 to push the bottom surface 210L of the touch panel 210. In addition, the heating baking plate 130 further includes through holes 132. The through holes 132 are arranged on the heat generating surface 131 and penetrate through a bottom surface 133 of the heating baking plate 130 opposite to the heat generating surface 131. The pushing pins 142 are respectively received in the through holes 132, and are moved with the lifting body 141 so as to be reciprocally ascended and descended in the through holes 132.

Figure 3:
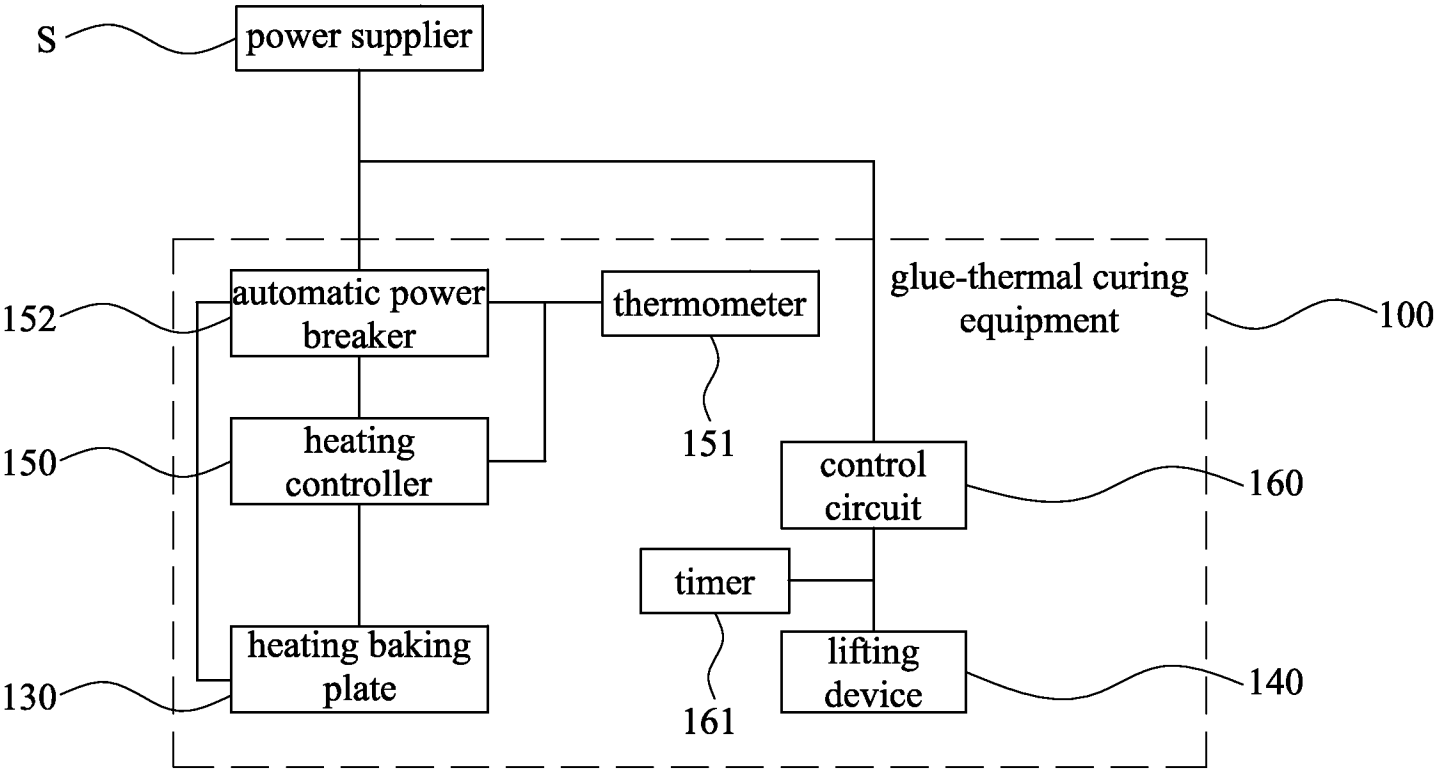
FIG. 3 is a block diagram showing an electrical connection of the glue-thermal curing equipment according to another embodiment of the present disclosure.

FIG. 3 is a block diagram showing an electrical connection of the glue-thermal curing equipment 100 according to another embodiment of the present disclosure. The glue-thermal curing equipment 100 further includes a heating controller 150 and a thermometer 151. The glue-thermal curing equipment 100 is electrically connected to a power supply S, so that the glue-thermal curing equipment 100 can obtain the required electric power. An automatic power breaker 152 is electrically connected to the heating controller 150, the heating baking plate 130 and the power supply S. The thermometer 151 can measure the current internal temperature of the chassis 110 (shown in FIG. 1). The heating controller 150 is electrically connected to the heating baking plate 130, and can control the temperature variation of the heating baking plate 130. For instance, the heating controller 150 is, for example, a proportional-integral-derivative (PID) controller, for dynamically adjusting the thermal energy provided by the heating baking plate 130 with respect to the internal temperature of the chassis 110 (shown in FIG. 1) and a preset target temperature until the difference between the internal temperature and the target temperature is reduced to a small range, so that the heating amplitude of the glue-thermal curing equipment 100 can be more accurate and stable. Because the proportional-integral-derivative (PID) controller is a common feedback loop unit used in industrial controlling application, no further illustration is provided.

The automatic power breaker 152 can automatically cut off the power supplied by the power supply S to the heating baking plate 130, or switches the heating controller 150 to stop providing thermal energy when the automatic power breaker 152 determines the internal temperature of the chassis 110 (shown in FIG. 1) exceeds the target temperature.

The glue-thermal curing equipment 100 further includes a control circuit 160 and a timer 161. The control circuit 160 is electrically connected to the lifting device 140 and the timer 161. The control circuit 160 is used for sequentially controlling the ascending and descending of the lifting device 140 with respect to a preset time provided by the timer 161. For example, as shown in FIG. 2 and FIG. 3, when the pushing pins 142 protrude from the heat generating surface 131 for allowing the touch panel 210 to be disposed, the control circuit 160 controls the lifting device 140 to be descended until the touch panel 210 is in direct contact with the heat generating surface 131 so as to be baked and dried, and the timer 161 starts to count time; on the other hand, when the timer 161 informs the control circuit 160 that the predetermined time (e.g., 30 seconds to 2 minutes) has been reached, the control circuit 160 allows the lifting device 140 to be lifted until the pushing pins 142 enable the touch panel 210 to be completely not in contact with the heat generating surface 131.

Figure 4:
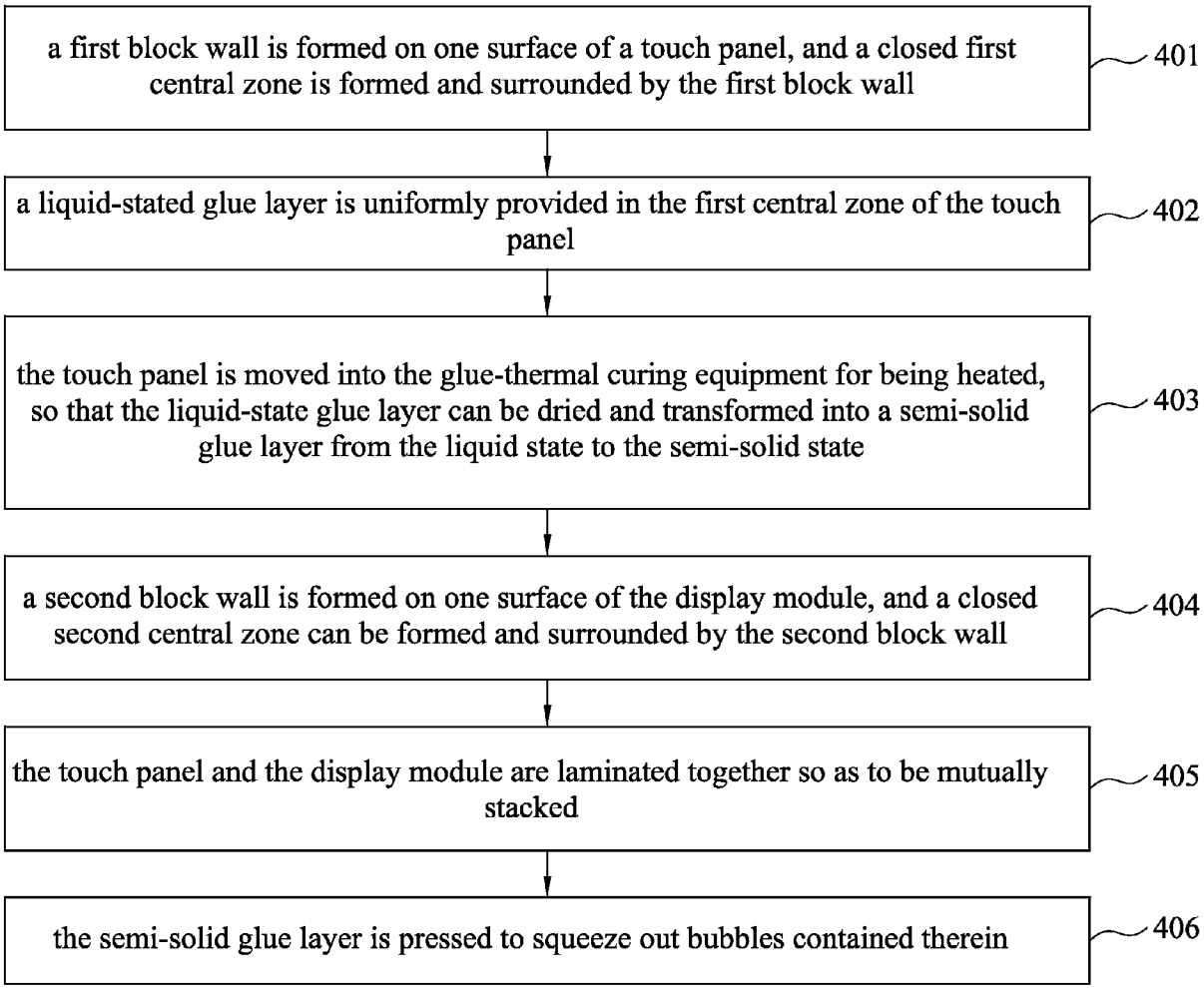
FIG. 4 is a flowchart showing a manufacturing procedure of a touch display module.

FIG. 4 is a flowchart showing a manufacturing procedure of a touch display module 200. As shown in FIG. 4, the manufacturing procedure of the touch display module 200 is as follows. In STEP 401, a first block wall is formed on one surface of a touch panel, and a closed first central zone is formed and surrounded by the first block wall. In STEP 402, a liquid-stated glue layer is uniformly provided in the first central zone of the touch panel. In STEP 403, the touch panel is moved into the glue-thermal curing equipment for being heated, so that the liquid-state glue layer can be dried and transformed into a semi-solid glue layer from the liquid state to the semi-solid state. In STEP 404, a second block wall is formed on one surface of the display module, and a closed second central zone can be formed and surrounded by the second block wall. In STEP 405, the touch panel and the display module are laminated together so as to be mutually stacked. Thereafter, in STEP 406, the semi-solid glue layer is pressed to squeeze out bubbles contained therein.

Figure 5B:
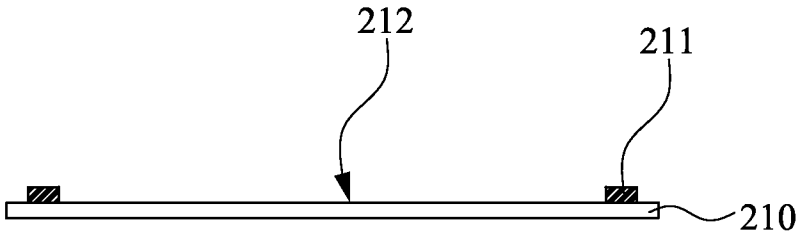
FIG. 5*b* is a cross sectional view viewed along a line A-A of FIG. 5*a;*
Figure 5A:
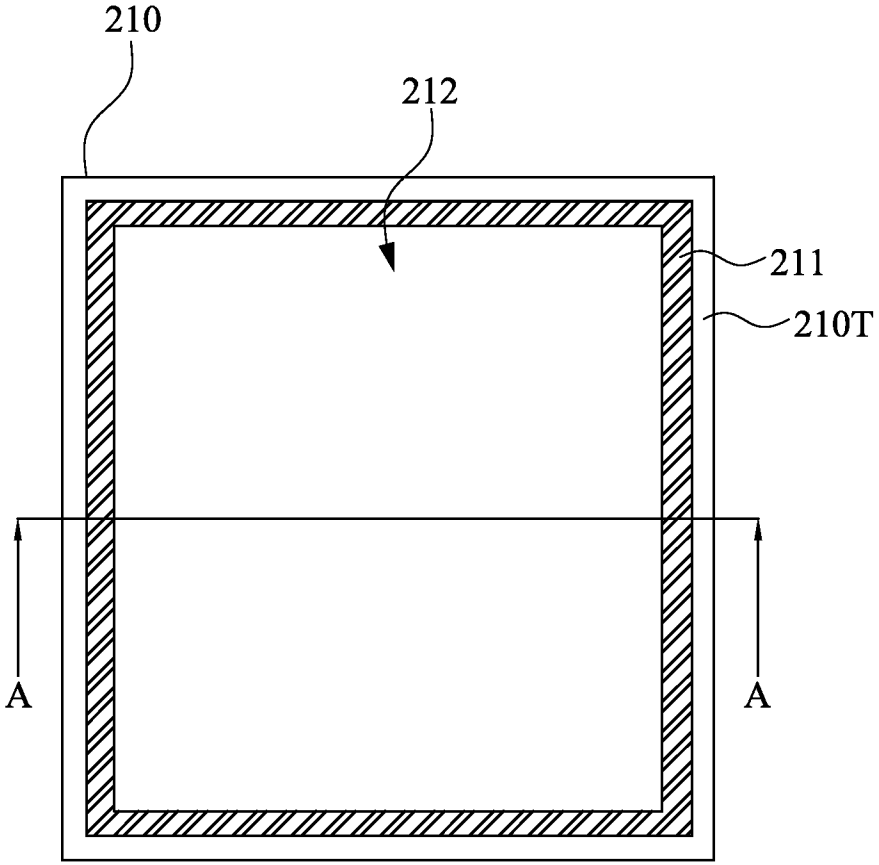
FIG. 5*a* is a front view showing a touch panel disclosed in STEP 401 of FIG. 4.

Reference is now made to FIG. 5*a* and FIG. 5*b* in which FIG. 5*a* is a front view showing the touch panel 201 disclosed in STEP 401 of FIG. 4, and FIG. 5*b* is a cross sectional view viewed along the line A-A of FIG. 5*a*. As shown in FIG. 5*a* and FIG. 5*b*, in STEP 401, a first curing glue (a photo or thermal curing glue) is provided at the periphery of a surface 210T of the touch panel 210, thereby forming a closed first central zone 212 surrounded by the first curing glue, and the first curing glue is cured to form the first block wall 211.

Figure 6:
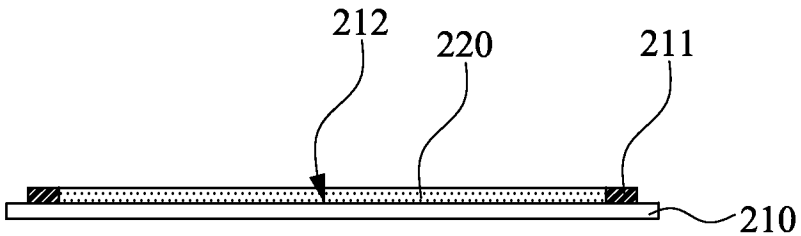
FIG. 6 is a cross sectional view showing the touch panel disclosed in STEP 402 of FIG. 4 viewed along the line A-A of FIG. 5*a;*

FIG. 6 is a cross sectional view showing the touch panel 210 disclosed in STEP 402 of FIG. 4 viewed along the line A-A of FIG. 5*a*. As shown in FIG. 6, in STEP 402, a liquid-state glue layer 220 is provided in the first central zone 212, and a glue scraper is utilized for allowing the liquid-state glue layer 220 to be uniformly distributed on every area of the first central zone 212 of the touch panel 210.

As shown in FIG. 1, in STEP 403, the touch panel 210 is moved into the aforementioned glue-thermal curing equipment 100 for being heated, so the liquid-state glue layer 220 can be dried and transformed into a semi-solid glue layer 221 (see FIG. 2) from the liquid state.

Figure 7B:
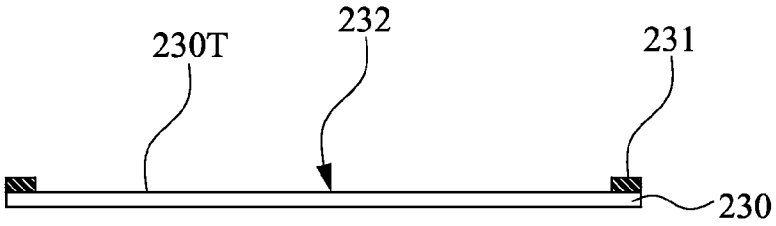
FIG. 7*b* is a cross sectional view viewed along a line B-B of FIG. 7*a*.
Figure 7A:
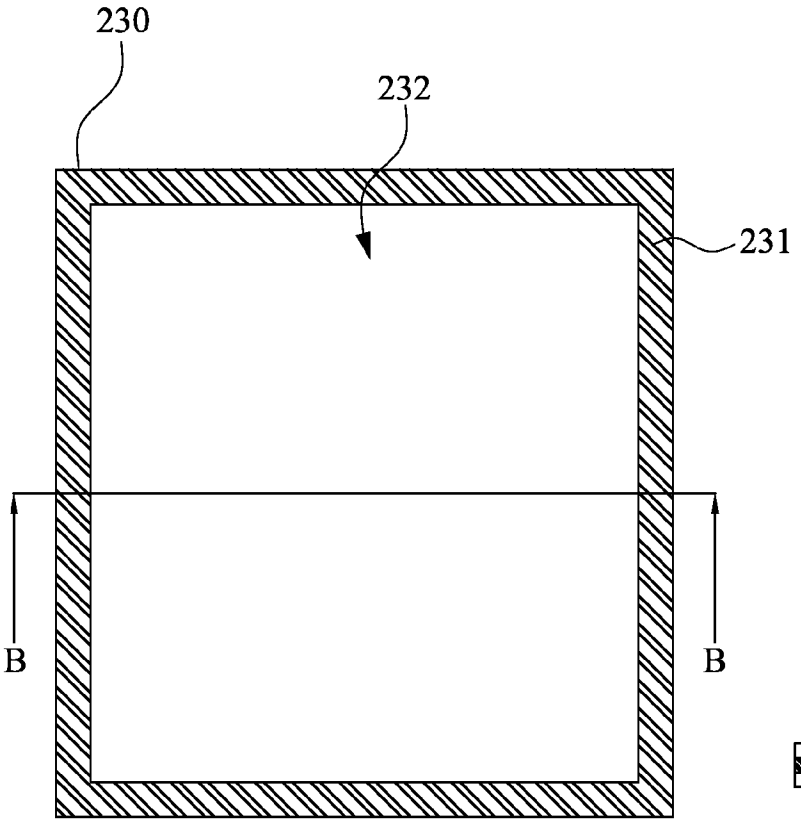
FIG. 7*a* is a front view showing a display module disclosed in STEP 404 of FIG. 4.

FIG. 7*a* is a front view showing the display module 230 disclosed in STEP 404 of FIG. 4, and FIG. 7*b* is a cross sectional view viewed along the line B-B of FIG. 7*a*. As shown in FIG. 7*a* and FIG. 7*b*, in STEP 404, a second curing glue (e.g., curing silicon) is provided at the periphery of a surface 230T of the display module 230, so that a closed second central zone 232 is formed and surrounded by the second curing glue. The second curing glue is cured for forming the second block wall 231, wherein the second central zone 232 is larger than the first central zone 212.

Figure 8:
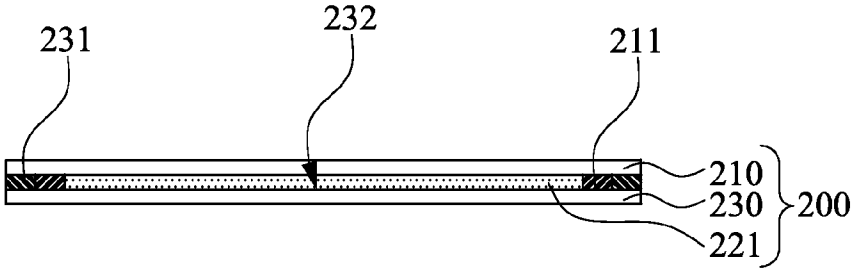
FIG. 8 is a cross sectional view showing the touch display module disclosed in STEP 405 of FIG. 4 viewed along the line B-B of FIG. 7*a*.

FIG. 8 is a cross sectional view showing the touch display module 200 disclosed in STEP 405 of FIG. 4 viewed along the line B-B of FIG. 7*a*. As shown in FIG. 8, in STEP 405, the touch panel 210 is stacked with the display module 230, so that the glue layer 221 and the first block wall 211 can be disposed in the second central zone 232, and the touch panel 210 can be mutually adhered with the display module 230 through the glue layer 221 disposed therebetween.

Moreover, in STEP 406, the glue layer 221 is pressurized by for example, applying 2 atmospheres of air to the glue layer 221 for squeeze out bubbles contained in the glue layer 221, such that the touch panel 210 is more tightly laminated with the display module 230.

As what has been disclosed above, the heating baking plate of the glue-thermal curing equipment provided by the present disclosure allows the liquid-state glue layer on the touch panel to be uniformly heated, so that the baking and drying progress of the liquid-state glue layer on the touch panel can be substantially the same, and the thickness and viscosity of the glue layer is the same (or substantially the same), thus effectively ensuring the quality of the touch panel adhered on a display module and the average service life.

Although the present disclosure has been described with reference to the preferred embodiments thereof, it is apparent to those skilled in the art that a variety of modifications and changes may be made without departing from the scope of the present disclosure which is intended to be defined by the appended claims.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract, and drawings) may be replaced by alternative features serving the same, equivalent or similar purpose, unless expressly state otherwise. Thus, unless expressly stated otherwise, each feature disclosed is one example only of a generic series of equivalent or similar features.

What is claimed is:

1. A glue-thermal curing equipment used for baking and drying a liquid-state glue layer applied on at least one panel device from a liquid state to a semi-solid state, the glue-thermal curing equipment comprising:

a chassis formed with an accommodation space therein;

at least one support fixedly disposed in the accommodation space;

at least one heating baking plate disposed on the support, a top surface of the heating baking plate acting as a heat generating surface, wherein the heat generating surface allows the panel device to be directly disposed thereon, and any area of the heat generating surface generates the same thermal energy; and at least one lifting device elevatably disposed on the support for lifting the panel device away from the heat generating surface.

2. The glue-thermal curing equipment according to claim 1, wherein the heating baking plate further comprises:

a vacuum channel disposed in the heating baking plate; and a plurality of heating bars arranged with intervals in the vacuum channel, wherein a longitudinal axial direction of each of the heating bars is perpendicular to a gravity direction.

3. The glue-thermal curing equipment according to claim 1, wherein the at least one heating baking plate further comprises a protective layer coated on the heat generating surface.

4. The glue-thermal curing equipment according to claim 3, wherein the protective layer is a Teflon film.

5. The glue-thermal curing equipment according to claim 1, wherein the interior of the chassis is provided with an internal temperature of 100 degrees Celsius to 120 degrees Celsius after the at least one heating baking plate generates heat.

6. The glue-thermal curing equipment according to claim 1, wherein the lifting device further comprises:

a lifting body elevatably disposed on the support; and a plurality of pushing pins connected to the lifting body and lifted along with the lifting body for pushing the panel device.

7. The glue-thermal curing equipment according to claim 6, wherein the at least one heating baking plate further comprises:

a plurality of through holes arranged on the heat generating surface and penetrating through a bottom surface of the heating baking plate, wherein the support is disposed between the heating baking plate and the lifting body, and the pushing pins are respectively received in the through holes and are lifted with the lifting body to protrude from the through holes for pushing the panel device.

8. The glue-thermal curing equipment according to claim 1, wherein when the number of the at least one support, the number of the at least one heating baking plate and the number of the at least one lifting device are greater than one, the supports are arranged with intervals in the accommodation space, the heating baking plates are respectively disposed on the supports, and the lifting devices are elevatably disposed on the supports respectively.

9. The glue-thermal curing equipment according to claim 1, further comprising:

a thermometer for measuring an internal temperature of the chassis; and a heating controller electrically connected to the thermometer and the heating baking plate for dynamically adjusting the thermal energy provided by the heating baking plate with respect to a difference between the internal temperature and a target temperature, the heating controller further comprising an automatic power breaker electrically connected to a power supply, wherein when the internal temperature of the chassis exceeds the target temperature, the automatic power breaker automatically cuts off the power supplied from the power supply to the heating baking plate.

10. The glue-thermal curing equipment according to claim 1, further comprising:

a control circuit electrically connected to the lifting device, and reciprocally controlling the ascending and descending of the lifting device in accordance with a preset heating time.

* * * * *